US011352762B2

(12) United States Patent
Tissier et al.

(10) Patent No.: US 11,352,762 B2
(45) Date of Patent: Jun. 7, 2022

(54) COUPLER ASSEMBLY TO ROTATABLY COUPLE BRACKETS TO BEAMS

(71) Applicant: Caterpillar Inc., Deerfield, IL (US)

(72) Inventors: Nathan Tissier, Champaign, IL (US); Nathaniel Harshman, Sullivan, IL (US); David Cox, Monticello, IL (US)

(73) Assignee: Caterpillar Inc., Peoria, IL (US)

( * ) Notice: Subject to any disclaimer, the term of this patent is extended or adjusted under 35 U.S.C. 154(b) by 508 days.

(21) Appl. No.: 16/406,180

(22) Filed: May 8, 2019

(65) Prior Publication Data

US 2020/0354922 A1 Nov. 12, 2020

(51) Int. Cl.
*E02F 3/815* (2006.01)
*E02F 3/76* (2006.01)

(52) U.S. Cl.
CPC ..... *E02F 3/8157* (2013.01); *E02F 3/764* (2013.01)

(58) Field of Classification Search
CPC ..... E02F 3/8157; E02F 3/764; E02F 3/7636; E02F 3/7645; E02F 3/765; E02F 3/7654; E02F 3/7659
See application file for complete search history.

(56) References Cited

U.S. PATENT DOCUMENTS 3,512,589 A * 5/1970 Ulrich ..... E02F 3/815 172/786
5,743,342 A * 4/1998 Gibbs ..... E02F 3/764 172/734
6,698,932 B2 * 3/2004 Hamaguchi ..... F16C 11/045 384/275
6,877,259 B2 * 4/2005 Nishimura ..... E02F 3/3604 37/403
6,926,779 B1 * 8/2005 Bin ..... B32B 15/017 148/432
7,448,823 B2 * 11/2008 Silva ..... F16G 15/06 403/325
9,765,808 B2 * 9/2017 Ginn ..... E02F 9/006
10,982,540 B2 * 4/2021 Crystal ..... E21C 25/36
2015/0060098 A1 3/2015 Pohl
2018/0238370 A1 8/2018 Simpson et al.
2020/0024822 A1 * 1/2020 Costner, III ..... E02F 3/8157

FOREIGN PATENT DOCUMENTS

CN 2265661 Y 10/1997
JP 2009041659 A 2/2009

* cited by examiner

*Primary Examiner* — Jamie L McGowan

(57) ABSTRACT

A coupler assembly for rotatably coupling a moldboard of a grader machine includes a bracket, a beam, a pin, a retainer, and an apparatus. The bracket is adapted to support the moldboard. The beam extends from a circle member rotatably coupled relative to a drawbar of the grader machine. The pin is adapted to rotatably couple the bracket and the beam to each other. Further, the pin defines an end adapted to extend outwardly from an assembly of the bracket and the beam. The retainer is adapted to be engaged with the end to retain the pin with the assembly of the beam and the bracket. Moreover, the retainer defines at least one end portion extending outwardly from the end. The apparatus is adapted to be mounted around the pin at the end to shield the at least one end portion of the retainer extending outwardly from the end.

20 Claims, 4 Drawing Sheets

COUPLER ASSEMBLY TO ROTATABLY COUPLE BRACKETS TO BEAMS

TECHNICAL FIELD

The present disclosure relates to a grader machine. More particularly, the disclosure relates to a coupler assembly to rotatably couple a moldboard of the grader machine.

BACKGROUND

In several applications, a requirement to couple (e.g., rotatably) one component with the other is met by the use of couplers or coupler assemblies. One, among the many areas of application of coupler assemblies is found in machines where components such as beams, brackets, etc., of the machines may need to be rotatably coupled to each other. As an example, machines, such as grader machines, typically use a grader blade (also referred to as moldboard) to displace, distribute, mix, and grade material, such as soil, over a work surface. Grader blades may need to be moved to a variety of positions relative to a work surface to effectively carry out one or more of the aforesaid functions, and, to do so, a bracket to which the grader blade may be operatively coupled to, may be in turn tiltably (e.g., rotatably) coupled to an adjacent structure (such as to a beam extending from a circle member of the grader machine). To facilitate coupling between such a beam and a bracket, a coupler assembly is commonly used. Such coupler assemblies often include one or more devices, such as a pin about which the bracket and the beam may be rotatably coupled to, and a bolt that may help retain the pin with the beam and the bracket. More often than not, the coupler assembly assumes a configuration in which the bolt may jut out (e.g., excessively) to be exposed to the surrounding terrain, making such a bolt vulnerable to failure as they encounter the harshness of the surrounding terrain.

U.S. Pat. No. 6,698,932 relates to a bearing assembly including a boss, left and right brackets, a pin, and a lock plate. The pin is inserted into the boss and into the left and right brackets. The lock plate is attached to one of the brackets by screws, and has a hole through which the pin is inserted. The lock plate and the pin are connected by a screw inserted at a right angle to an axis of the pin and secured by a nut, which prevents the pin from pivoting and falling out of the bore.

SUMMARY OF THE INVENTION

In one aspect, the disclosure is directed towards a coupler assembly. The coupler assembly rotatably couples a moldboard of a grader machine, and includes a bracket, a beam, a pin, a retainer, and an apparatus. The bracket is adapted to support the moldboard. The beam extends from a circle member rotatably coupled relative to a drawbar of the grader machine. The pin is adapted to be passed through and rotatably couple the bracket and the beam to each other about the pin. Further, the pin defines an end adapted to extend outwardly from an assembly of the bracket and the beam. The retainer is adapted to be engaged with the end to retain the pin with the assembly of the beam and the bracket. Moreover, the retainer defines at least one end portion extending outwardly from the end. The apparatus is adapted to be mounted around the pin at the end to shield the at least one end portion of the retainer extending outwardly from the end.

In another aspect, the disclosure relates to a grader machine. The grader machine includes a main frame portion, a sub-frame portion, a drawbar, a circle member, a beam, a bracket, a pin, a retainer, and an apparatus. The sub-frame portion is movable relative to the main frame portion. The drawbar is pivotally coupled to the sub-frame portion and is adapted to be raised and lowered relative to the sub-frame portion. The circle member is rotatably coupled relative to the drawbar. The beam extends from the circle member. The bracket supports a moldboard for engaging a work surface underlying the grader machine. The pin is passed through and rotatably couples the bracket and the beam to each other about the pin, and defines an end extending outwardly from an assembly of the bracket and the beam. The retainer is engaged with the end to retain the pin with the bracket and the beam. Moreover, the retainer defines at least one end portion extending outwardly from the end. The apparatus is adapted to be mounted around the pin at the end to shield the at least one end portion of the retainer extending outwardly from the end.

DETAILED DESCRIPTION

Reference will now be made in detail to specific embodiments or features, examples of which are illustrated in the accompanying drawings. Generally, corresponding reference numbers will be used throughout the drawings to refer to the same or corresponding parts.

Figure 1:
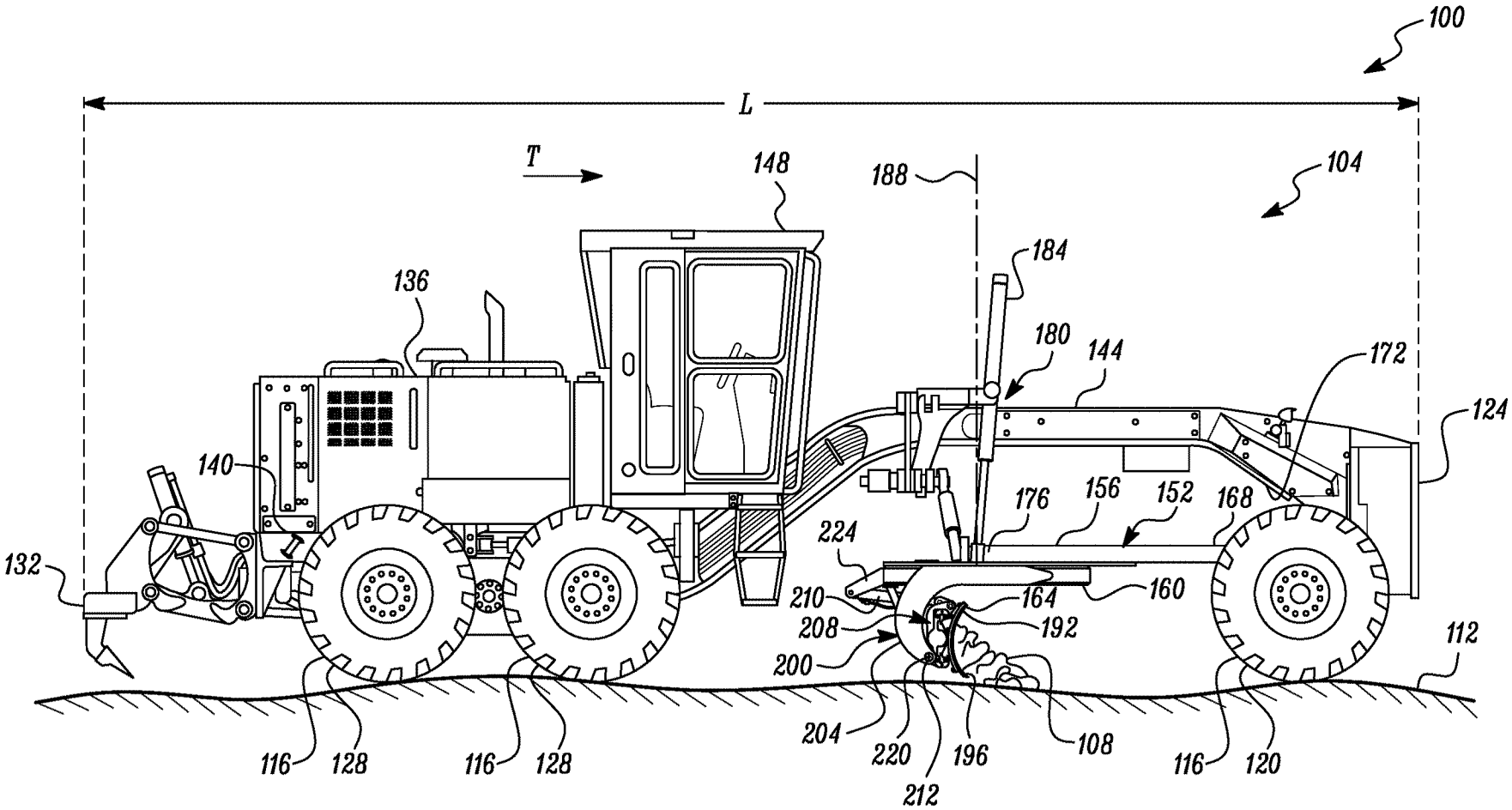
FIG. 1 is a grader machine including an exemplary circle assembly depicted in conjunction with a coupler assembly for rotatably coupling a moldboard of the grader machine relative to one or more beams of the circle assembly, in accordance with an embodiment of the present disclosure.

Referring to FIG. 1, a grader machine 100 is shown, and as depicted, is a motor grader 104. The grader machine 100 may be used to displace, spread, distribute, level, and grade, materials 108, such as soil, over a work surface 112. Generally, a grading operation is performed during machine movement, and for this purpose, the grader machine 100 may include traction devices 116 that facilitate machine movement over the work surface 112 underlying the grader machine 100. For example, traction devices 116 include a set of front wheels 120 disposed towards a front end 124 of the grader machine 100 and a set of rear wheels 128 disposed towards a rear end 132 of the grader machine 100. The terms 'front' and 'rear', as used herein, are in relation to an exemplary direction of travel of the grader machine 100, as represented by arrow, T, in FIG. 1, with said direction of travel being exemplarily defined from the rear end 132 towards the front end 124. The grader machine 100 defines a length, L, between the front end 124 and the rear end 132.

A movement of the traction devices 116 (i.e., a rotation of the set of front wheels 120 and the set of rear wheels 128) may be powered by a power source, such as an engine (not shown), housed in a power compartment 136 of the grader machine 100. Further, the grader machine 100 may include a main frame portion 140 and a sub-frame portion 144. The sub-frame portion 144 may be movable relative to the main frame portion 140. Further, the grader machine 100 may include an operator cab 148 supported on the sub-frame portion 144, and which may house various controls of the power source and other functions of the grader machine 100.

To grade and level the materials 108, the grader machine 100 may include a drawbar-circle-blade (DCB) arrangement—also referred to as a grader group 152. The grader group 152 may be supported by the sub-frame portion 144, and may include a drawbar 156, a circle member 160, and a blade (referred to as a moldboard 164), each of which may function in concert to perform a grading operation on the work surface 112.

The drawbar 156 may include a first end 168 pivotally coupled to a front end portion 172 of the sub-frame portion 144 and a second end 176 movably supported by another portion (such as a mid-portion 180) of the sub-frame portion 144. For example, the second end 176 of the drawbar 156 may be coupled to the mid-portion 180 of the sub-frame portion 144 via one or more actuators, such as a hydraulic actuator 184. The hydraulic actuator 184 may be actuated to raise or lower the second end 176 of the drawbar 156 with respect to the sub-frame portion 144, in turn allowing the drawbar 156 and the grader group 152 to be raised or lowered relative to the sub-frame portion 144 or the work surface 112. The circle member 160 of the grader group 152 may be rotatably coupled to the drawbar 156, and accordingly may be rotatable relative to the drawbar 156 about a rotation axis 188 that passes through a center of the circle member 160. The moldboard 164 may be supported by (and/or suspended from) the circle member 160 to rotate along with the rotation of the circle member 160 about the rotation axis 188. The moldboard 164 may include a face 192, such as a concave face, that may help receive and agglomerate the materials 108 over the work surface 112, as shown. As an example, the moldboard 164 may define an edge 196 at a bottom end (i.e., closer to the work surface 112) of the face 192 to help engage and scrape the materials 108 off the work surface 112 and distribute, level, and grade the work surface 112, during a grading operation.

Figure 2:
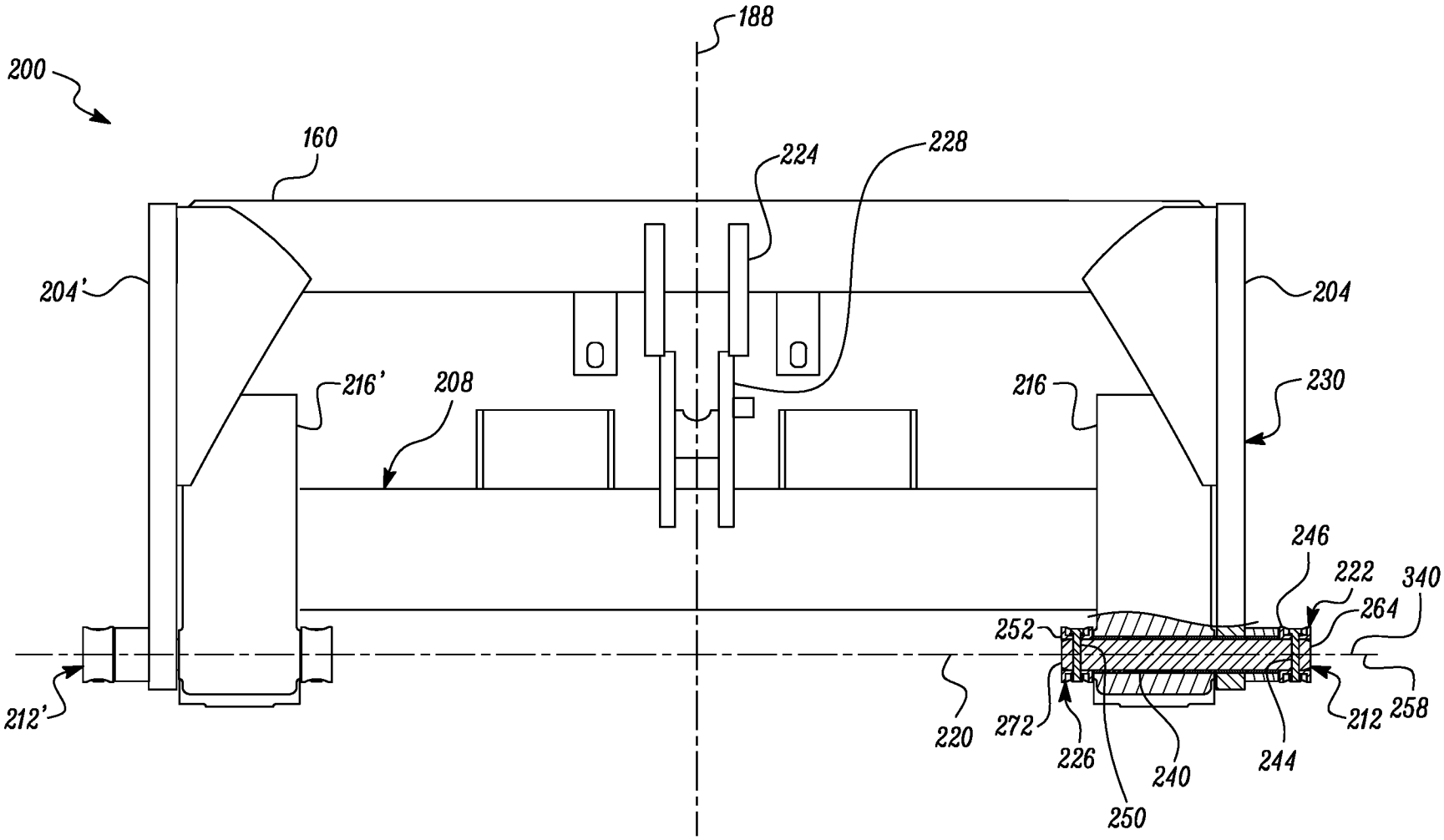
FIG. 2 is a rear side view of the circle assembly in conjunction with the coupler assembly, with one or more beams of the coupler assembly being rotatably coupled to a bracket supporting the moldboard by way of a pair of couplings, in accordance with an embodiment of the present disclosure.

Referring to FIGS. 1 and 2, and according to an aspect of the present disclosure, the moldboard 164 is coupled to the circle member 160 by way of a coupler assembly 200. The coupler assembly 200 includes a pair of beams 204, 204' (also see FIG. 2) a bracket 208, and a pair of couplings (e.g., a first coupling 212 and a second coupling 212') (FIG. 2), details pertaining to each of which will now be discussed.

The pair of beams 204, 204' may be fixedly coupled to the circle member 160 thus being rotatable as the circle member 160 executes a rotation relative to the drawbar 156. The pair of beams 204, 204' may extend (e.g., towards the work surface 112) from the circle member 160 in an axial direction (such as along the rotation axis 188). It may be noted that only one of the beams 204, 204' (i.e., beam 204) is shown in FIG. 1 since the other of the pair of beams (i.e., beam 204') is hidden behind the beam 204 in the orientation of the grader group 152 provided in FIG. 1. Nevertheless, the other of the pair of beams (i.e., beam 204') may be viewed in FIG. 2. The beams 204, 204' may be diametrically opposed and spaced apart from each other across the circle member 160. For ease of understanding, the pair of beams 204, 204' may be independently referred to as a first beam 204 and a second beam 204'.

The bracket 208 may slidably support the moldboard 164 by way of a retention assembly (not explicitly shown) so as to allow the moldboard 164 to slide sideways relative to the bracket 208. The bracket 208 may define a first bracket portion 216 and a second bracket portion 216'. The first bracket portion 216 may be rotatably coupled to the first beam 204, while the second bracket portion 216' may be rotatably coupled to the second beam 204'.

The pair of couplings 212, 212' facilitate the aforesaid rotatable coupling between the bracket 208 and the pair of beams 204, 204', and enables the bracket 208 to tilt relative to the first beam 204 and the second beam 204' about a common tilt axis 220. As noted above, the pair of couplings 212, 212' may include (and/or be individually referred to as) a first coupling 212 and a second coupling 212'. The first coupling 212 may rotatably couple the first beam 204 with the first bracket portion 216 of the bracket 208, while the second coupling 212' may rotatably couple the second beam 204' with the second bracket portion 216' of the bracket 208. An actuator 210 (see FIG. 1) may be coupled between a pivoting joint 224 disposed on the circle member 160 and hinge plates 228 disposed on the bracket 208. The actuator 210, upon actuation, may allow the bracket 208 to be tilted (or rotated) relative to the circle member 160 and the pair of beams 204, 204' about the common tilt axis 220—in turn allowing the moldboard 164 to tilt (or rotate) about the common tilt axis 220 and relative to the pair of beams 204, 204' to assume various positions, as desired during operations.

The forthcoming disclosure includes details pertaining to the pair of couplings 212, 212' and their arrangement with the pair of beams 204, 204'. Such details have been discussed by way of reference to the first coupling 212, the first beam 204, and the first bracket portion 216 of the bracket 208. Similar or equivalent details may be contemplated for the second coupling 212', second beam 204', and the second bracket portion 216', as well. Wherever required, reference to the second coupling 212', and components thereof, may also be explicitly used. Such references may use nomenclatures and annotations similar to those that have been used for the first coupling 212, but may be differentiated by a 'prime mark'. For ease, the first coupling 212 will be interchangeably referred to as a coupling 212. The first beam 204 may also be simply referred to as beam 204. The coupling 212 includes a pin 240 and two retainer sets (e.g., a first retainer set 222 and a second retainer set 226) that help retain the pin 240 to an assembly 230 of the beam 204 and the bracket 208 (i.e., to the first bracket portion 216 of the bracket 208). The first retainer set 222 includes a first retainer 244, a first apparatus 246, and a first nut 248, while the second retainer set 226 includes a second retainer 250, a second apparatus 252, and a second nut 254, as shown.

Figure 3:
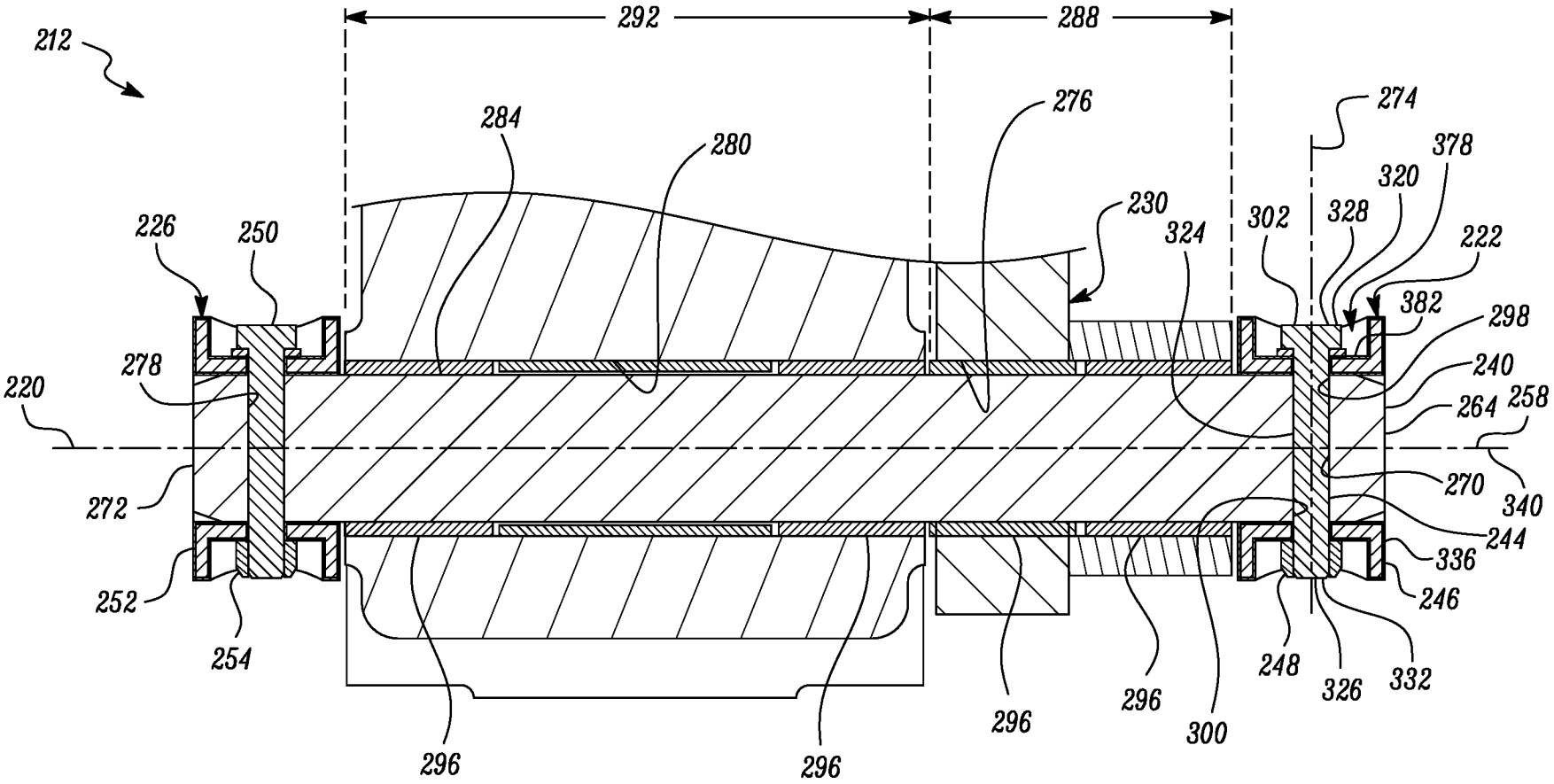
FIG. 3 is an enlarged cross-sectional view of the one of the couplings of the pair of couplings, in accordance with an embodiment of the present disclosure.

Referring to FIGS. 2 and 3, the pin 240 may include an elongated profile. For example, the pin 240 defines a longitudinal axis 258, and may extend along the longitudinal axis 258. The pin 240 may be a single piece component, having a circular cross-sectional area defined around the longitudinal axis 258, along and throughout a length of the pin 240. Nonetheless, in some cases, it may be contemplated that the pin 240 may include one or more sections having cross-sections that are non-circular. Further, the pin 240 defines a first axial end or simply a first end 264 and an oppositely defined, second axial end or simply a second end 272. The pin 240 may be made from any relatively high grade reinforced material, such as reinforced steel, to effectively withstand the stresses of operation.

In an assembly of the pin 240 with the assembly 230 of the beam 204 and the bracket 208, the pin 240 may pass through the beam 204 and the first bracket portion 216 of the bracket 208 to rotatably couple the beam 204 and the first bracket portion 216 of the bracket 208 about the pin 240. For this purpose, each of the beam 204 and the first bracket portion 216 may include respective passageways (e.g., circular passageways) to allow the pin 240 to pass through. For example, the beam 204 includes a first passageway 276 and the first bracket portion 216 of the bracket 208 includes a second passageway 280. In further detail, the pin 240 defines an outer surface 284 (e.g., a cylindrically-shaped outer surface), and said outer surface 284 defines sections, for example, a first section 288 and a second section 292 corresponding to which the beam 204 and the first bracket portion 216 may lie in rotatable registration with the pin 240. For example, the first passageway 276 of the beam 204 may lie in rotatable registration with the first section 288 of the outer surface 284 of the pin 240, while the second passageway 280 of the first bracket portion 216 may lie in rotatable registration with the second section 292 of the outer surface 284 of the pin 240.

Although not limited, both the first passageway 276 and the second passageway 280 may include similarly sized and dimensioned cross-sectional areas that may rotatably receive the first section 288 and the second section 292 therein. According to some examples, a passage of the pin 240 through the first passageway 276 and the second passageway 280 is such that the longitudinal axis 258 is inline or co-axial with the common tilt axis 220 and is also co-axial with respective axes (not annotated to save clarity) defined by the first passageway 276 and the second passageway 280. Further, the cross-sectional areas of each of the first passageway 276 and the second passageway 280 may be larger than the cross-sectional area of the pin 240. The relatively larger cross-sectional area of the first passageway 276 and the second passageway 280 in comparison to the cross-sectional area of the pin 240 allows one or more bearings 296, such as bush bearings, to sit between the outer surface 284 of the pin 240 and each of the bracket 208 and the beam 204, permitting the pin 240 to freely and steadily rotate relative to the bracket 208 and the beam 204, about the common tilt axis 220.

With the pin 240 inserted into the first passageway 276 and the second passageway 280, each of the first end 264 and the second end 272 may sit outside the assembly 230 of the beam 204 and the bracket 208. As illustrated in FIGS. 2 and 3, for example, the first end 264 is revealed outwardly relative to the beam 204, while the second end 272 is revealed outwardly relative to the bracket 208 (i.e., to the first bracket portion 216 of the bracket 208). A position of the pin 240, as attained, refers to an 'engaged state' of the pin 240 with respect to the beam 204 and the bracket 208. Further, a first through-hole 270 may be structured and arranged to pass diametrically across the pin 240 at the first end 264 of the pin 240. The through-hole 270 may define a through-hole axis 274 and opposed openings, i.e., a first axial opening 298 and a second axial opening 300. Each of the first axial opening 298 and the second axial opening 300 may be revealed diametrically oppositely at the outer surface 284 of the pin 240. A second through-hole 278, similar to the first through-hole 270, may be structured and arranged to pass diametrically across the second end 272.

The first retainer set 222 is positioned or arranged at the first end 264, while the second retainer set 226 is positioned at the second end 272. In that manner, the first retainer set 222 and the second retainer set 226 are configured to retain the pin 240 with the assembly 230 of the beam 204 and the bracket 208. The forthcoming description will include description mostly directed towards the first retainer set 222 (as may be arranged) relative to the first end 264 and the first through-hole 270. Similar discussions may be contemplated for the second retainer set 226 (as may be arranged) relative to the second end 272 and the second through-hole 278, as well. For ease, components of the first retainer set 222, namely, the first retainer 244, the first apparatus 246, and the first nut 248, may be simply and respectively referred to as retainer 244, apparatus 246, and nut 248. The first end 264 of the pin 240 may also be simply referred to as end 264 and the first through-hole 270 may be simply referred to as through-hole 270.

The retainer 244 may be coupled and/or engaged to the end 264 of the pin 240 to facilitate retention of the pin 240 with the assembly 230 of the beam 204 and the bracket 208. The retainer 244 may include a bolt 302 defining a head portion 320 and a shank portion 324 integrally extending from the head portion 320. The head portion 320 may define an end portion 328 of the retainer 244, and may define a cross-sectional area that is larger than a cross-sectional area of the shank portion 324. In one example, the end portion 328 of the retainer 244, as defined by the head portion 320, may be referred to as a first end portion 328 of the retainer 244. The shank portion 324 of the retainer 244 may define another end portion or an end 326 (remote to the first end portion 328) referred to as a second end portion 332 of the retainer 244.

In an assembly of the retainer 244 with the end 264 of the pin 240, the retainer 244 may be passed through the through-hole 270, with the first end portion 328 of the retainer 244 being extended outwardly from the end 264 or revealed out of one of the first axial opening 298 or the second axial opening 300, and the second end portion 332 of the retainer 244 being extended outwardly from the end 264 or revealed out of the other of the first axial opening 298 or the second axial opening 300. According to the example illustration in FIGS. 2 and 3, the head portion 320 (i.e., the first end portion 328) of the retainer 244 is extended or revealed outwardly of the first axial opening 298 of the through-hole 270, while the second end portion 332 is extended or revealed outwardly of the second axial opening 300 of the through-hole 270.

Figure 4:
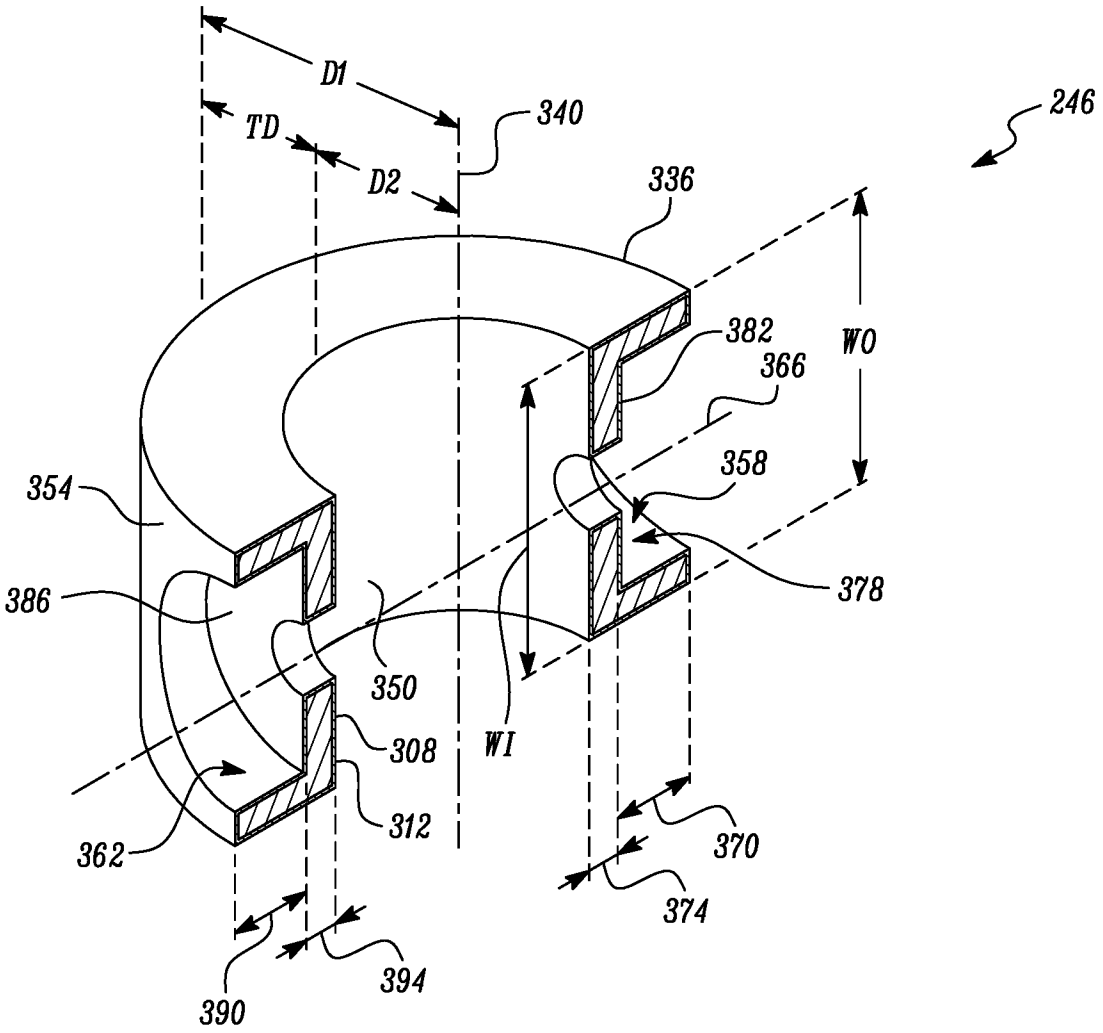
FIG. 4 is a perspective cross-sectional view of an apparatus of one of the couplings, in accordance with an embodiment of the present disclosure.

Referring to FIGS. 3 and 4, the apparatus 246 is mounted around the pin 240 at the end 264 of the pin 240 to shield the first end portion 328 and the second end portion 332 of the retainer 244. The apparatus 246 includes a collar-shaped, annular body 336 (FIG. 4) that defines an apparatus axis 340. The apparatus 246 is co-axially mounted around the pin 240 at the end 264 such that the apparatus axis 340 aligns with the longitudinal axis 258 of the pin 240. The apparatus 246 (or the annular body 336 of the apparatus 246) defines an inner peripheral surface 350 and an outer peripheral surface 354. The outer peripheral surface 354 is disposed at an offset (e.g., at a constant offset thickness, TD) with respect to the inner peripheral surface 350. In other words, the outer peripheral surface 354 is disposed concentrically around and relative to the inner peripheral surface 350, with the apparatus axis 340 being common to both the outer peripheral surface 354 and the inner peripheral surface 350, and with the outer peripheral surface 354 defining a larger diameter, D1, than a diameter, D2, defined by the inner peripheral surface 350. Moreover, in assembly of the apparatus 246 with the first end 264 of the pin 240, the inner peripheral surface 350 is disposed radially closer to the pin 240 and is directed towards a portion of the outer surface 284 defined at the end 264 of the pin 240, while the outer peripheral surface 354 is disposed radially relatively farther and is directed away from the portion of the outer surface 284 defined at the end 264 of the pin 240. Furthermore, in some embodiments, the inner peripheral surface 350 may include a width, WI, that remains consistent throughout the curvature of the inner peripheral surface 350, and a width, WO, of the outer peripheral surface 354 may be equal to the width, WI, of the inner peripheral surface 350.

The apparatus 246 includes a first slot 358 and a second slot 362. Both the first slot 358 and the second slot 362 may be defined around a common axis 366, and may be disposed diametrically oppositely to each other across the annular body 336 of the apparatus 246, although variations to such a layout is possible—for example, the first slot 358 and the second slot 362 may be disposed in a manner such that the respective axes (not explicitly annotated) defined by the first slot 358 and the second slot 362 are defined in different planes. For example, such axes may be tilted relative to each other, or, in other words, may define an angle unequal to 180 degrees, therebetween, in some cases. Each of the first slot 358 and the second slot 362 may extend from the outer peripheral surface 354 to the inner peripheral surface 350.

The first slot 358 may include a first slot portion 370 extending from the outer peripheral surface 354 towards the inner peripheral surface 350, and a second slot portion 374 extending from the first slot portion 370 up to the inner peripheral surface 350. A cross-sectional area of the first slot portion 370 may be larger than a cross-sectional area of the second slot portion 374. In that way, the first slot portion 370 defines a counterbore 378 at an entry of the first slot 358 from the outer peripheral surface 354. Further, a step 382 is defined between the first slot portion 370 and the second slot portion 374. Both the first slot portion 370 and the second slot portion 374 may be defined around the common axis 366. Similar to the configuration and layout of first slot 358, the second slot 362 may also include a first slot portion 390 and a second slot portion 394, and a step 386 defined between the first slot portion 390 and the second slot portion 394 of the second slot 362, as shown.

In an assembled state of the apparatus 246 and the retainer 244 with the end 264 of the pin 240, the first slot 358 is adapted to receive and facilitate shielding of the first end portion 328 of the retainer 244, while the second slot 362 is adapted to receive and facilitate shielding of the second end portion 332 of the retainer 244. Given that the first end portion 328 of the retainer 244 includes the head portion 320 of the retainer 244, the first slot 358 receives and shields the head portion 320 of the retainer 244. For example, in said assembled state, the head portion 320 of the retainer 244 abuts and is seated atop the step 382, with the first slot portion 370 of the first slot 358 surrounding (e.g., wholly) the head portion 320 of the retainer 244 (see FIG. 3). Similarly, given that the second end portion 332 of the retainer 244 includes the end 326 of the shank portion 324, the second slot 362 receives and shields the second end portion 332 of the retainer 244. According to an example implementation, the second slot 362 wholly surrounds the second end portion 332 of the retainer 244.

Further, according to an example, the nut 248 is coupled to the second end portion 332 of the retainer 244 and is seated on the step 386 defined between the first slot portion 390 and the second slot portion 394 of the second slot 362. In the assembled state, as the second slot 362 receives and shields the second end portion 332 of the retainer 244, the first slot portion 390 of the second slot 362 may also surround (e.g., wholly) the nut 248 coupled to the second end portion 332 of the retainer 244.

Optionally or additionally, one or more shims or spacer plates or spacer members may be positioned in between the apparatus 246 and the first bracket portion 216. Further, the second retainer 250, the second apparatus 252, and the second nut 254, may be assembled to the second end 272 of the pin 240 in a manner similar to the assembly discussed for the retainer 244, apparatus 246, and the nut 248. Thus, no discussion corresponding to the configuration and assembly of the second retainer 250, the second apparatus 252, and the second nut 254, relative to the second end 272 of the pin 240, has been discussed.

In some embodiments, the pin 240 may include a head segment (not shown) at one of the first end 264 or the second end 272 and a shank segment (not shown) extending integrally from the head segment with an end of the shank segment defining the other of the first end 264 and the second end 272. In such a case, a passage of the pin 240 through the beam 204 and the bracket 208 may mean the passage of the shank segment through the beam 204 and the bracket 208, with the head segment sitting atop one of the beam 204 and the bracket 208 and the end of the shank segment being extended or revealed outwardly of the other of the beam 204 and the bracket 208. In such a case, one of the first retainer set 222 or the second retainer set 226 may be assembled to the end of the shank segment in a similar manner as has been discussed for the first retainer set 222 relative to the end 264 above. Moreover, in such a case, the other of the first retainer set 222 or the second retainer set 226 may be altogether omitted since the functionality of the other of the first retainer set 222 or the second retainer set 226 (of retaining the pin 240 within the assembly 230) may be imparted by the head segment seated atop one of the beam 204 and the bracket 208.

In one example, the apparatus 246 includes a layer 308 of an anti-seizure coating 312 disposed on the annular body 336. Such a layer 308 may help prevent a seizure of the apparatus 246 relative to the pin 240 and/or at an interface where the apparatus 246 may abut or contact the first bracket portion 216 of the bracket 208. The anti-seizure coating 312 also promotes wear and corrosion resistance of the annular body 336 of the apparatus 246. Such an anti-seizure coating 312 may be provided on the annular body 336 of the apparatus 246 by way of electroplating, or by other customary methods. For example, the anti-seizure coating 312 includes Nickel. A thickness of the layer 308 of the anti-seizure coating 312 is exaggerated in the FIG. 3 for clarity.

INDUSTRIAL APPLICABILITY

During an assembly of the pin 240 with the assembly 230 of the beam 204 and the bracket 208, an operator may first insert the pin 240 into the first passageway 276 and the second passageway 280 (defined by the beam 204 and the first bracket portion 216 of the bracket 208, respectively). If the pin 240 includes a constant cross-sectional area all throughout, as discussed and depicted in the disclosure, the pin 240 may be inserted from either sides of the assembly 230 of the beam 204 and the bracket 208—i.e., either the left-hand side or the right-hand side of the assembly 230 according to the configuration of the assembly 230 depicted in FIGS. 2 and 3. Once the pin 240 is inserted, the first end 264 and the second end 272 of the pin 240 may be revealed or may extend outward from either sides of the assembly 230, e.g., the first end 264 may be revealed outwardly of the beam 204 and the second end 272 may be revealed outwardly of the first bracket portion 216 of the bracket 208, as shown. At this point, the operator may mount the apparatus 246 to the first end 264 of the pin 240. The mounting of the apparatus 246 to the first end 264 may such that the first slot 358 may be aligned with the first axial opening 298 of the through-hole 270 and the second slot 362 may be aligned with the second axial opening 300 of the through-hole 270. In other words, the common axis 366 may be aligned with the through-hole axis 274.

Once the common axis 366 is aligned with the through-hole axis 274, the second end portion 332 of the retainer 244 (i.e., the end 326 of the shank portion 324) may be passed into the first slot 358 and further into the first through-hole 270 through the first axial opening 298 of the through-hole 270 until the second end portion 332 of the retainer 244 is revealed outwardly from and out of the second axial opening 300 of the through-hole 270. Once the second end portion 332 is revealed out of the second axial opening 300 of the through-hole 270, the retainer 244 may be pushed further until the second end portion 332 of the retainer 244 enters into the second slot 362 of the apparatus 246 and the head portion 320 of the retainer 244 abuts and sits on the step 382 defined between the first slot portion 370 and the second slot portion 374 of the first slot 358 of the apparatus 246. At this position, both the head portion 320 (i.e., the first end portion 328) and the second end portion 332 of the retainer 244 may extend outwardly from the end 264 of the pin 240, but may be received within the first slot 358 and the second slot 362 of the apparatus 246, respectively. Effectively, in the assembled state of the apparatus 246 and the retainer 244 with the end 264 of the pin 240, the retainer 244 passes through the end 264 and through each of the first slot 358 and the second slot 362.

The nut 248 is thereafter screwed or fastened into engagement with the second end portion 332 of the retainer 244, thus ably securing and retaining the apparatus 246 to the end 264 of the pin 240, and in turn retaining the pin 240 with the assembly 230 of the beam 204 and the bracket 208. A similar process may be followed for securing the second apparatus 252, the second retainer 250, and the second nut 254, to the second end 272 of the pin 240. With both the retainer sets (i.e., the first retainer set 222 and the second retainer set 226) engaged with the ends (i.e., the first end 264 and the second end 272) of the pin 240, the pin 240 is retained with the assembly 230 of the beam 204 and the bracket 208. A process, similar to what has been discussed above, may be contemplated for the assembly of the second coupling 212' with the second bracket portion 216' of the bracket 208 and the second beam 204'.

During operation, as the grader machine 100 performs a grading operation, the moldboard 164 may engage and scrape the materials 108 from the work surface 112, so as to receive the many materials 108 onto the face 192 of moldboard 164. The materials 108 of the work surface 112 may include a mix of debris, particles, dirt, sand, etc., of varying types, sizes, and forms, making it apt and apposite for the moldboard 164 to possess the requisite strength to cater to the influx of said materials 108 therein. As the moldboard 164 may engage and receive the materials 108, ensuing stresses may be developed within various parts of the coupler assembly 200—e.g., at the point or junction where the bracket 208 is coupled to the beam 204—i.e., the coupling 212. Alongside bearing such stresses, the coupling 212 may also endure the onslaught of the agglomerated and disintegrated particles rushing into the moldboard 164, during the grading operation.

Given the provision of the apparatus 246 around the end 264 of the pin 240, and with the first slot 358 and the second slot 362 (or the respective counterbores, e.g., counterbore 378) receiving (e.g., wholly) the either end portions (i.e., the first end portion 328 and the second end portion 332) of the retainer 244, said end portions of the retainer 244 remain adequately protected and shielded from any direct impact or onslaught of the agglomerated and disintegrated particles. As a result, the apparatus 246 prevents damage, deformation, breakage, and/or failure, to the retainer 244, and, rather, improves and prolongs the life of the retainer 244. In some environments or applications, agglomerated and disintegrated particles of the work surface 112 may also undesirably seep past and/or crowd into an interface defined between the pin 240 and the apparatus 246. Because the apparatus 246 includes the layer 308 of the anti-seizure coating 312 (e.g., including Nickel) disposed over the annular body 336, any premature wear and component deterioration owing to such seepage is prevented. It may further be noted that because the layer 308 of the anti-seizure coating 312 promotes wear resistance and anti-seizure characteristics, a more simplified assembly and dis-assembly of the apparatus 246 relative to the end 264 of the pin 240 may be achieved, thus reducing associated effort, time, and cost.

It will be apparent to those skilled in the art that various modifications and variations can be made to the system of the present disclosure without departing from the scope of the disclosure. Other embodiments will be apparent to those skilled in the art from consideration of the specification and practice of the system disclosed herein. It is intended that the specification and examples be considered as exemplary only, with a true scope of the disclosure being indicated by the following claims and their equivalent.

What is claimed is:

1. A coupler assembly to rotatably couple a moldboard of a grader machine, the coupler assembly comprising:

a bracket adapted to support the moldboard;

a beam extending from a circle member rotatably coupled relative to a drawbar of the grader machine;

a pin adapted to be passed through and rotatably couple the bracket and the beam to each other about the pin, the pin defining an end adapted to extend outwardly from an assembly of the bracket and the beam;

a retainer adapted to be engaged with the end to retain the pin with the assembly of the beam and the bracket, the retainer defining at least one end portion extending outwardly from the end; and an apparatus adapted to be mounted around the pin at the end to shield the at least one end portion of the retainer extending outwardly from the end, wherein the apparatus includes an annular body defining an outer peripheral surface, an inner peripheral surface, and at least one slot extending from the outer peripheral surface to the inner peripheral surface, the retainer is adapted to pass through the end and the at least one slot, and the at least one slot is adapted to receive and facilitate shielding of the at least one end portion of the retainer, the at least one slot includes a first slot portion extending from the outer peripheral surface towards the inner peripheral surface, and a second slot portion extending from the first slot portion to the inner peripheral surface, and a cross-sectional area of the first slot portion is larger than a cross-sectional area of the second slot portion defining a step between the first slot portion and the second slot portion.

2. The coupler assembly of claim 1, wherein the pin defines a longitudinal axis and the annular body of the apparatus defines an apparatus axis, the apparatus being adapted to be co-axially mounted around the pin at the end such that the apparatus axis aligns with the longitudinal axis.

3. The coupler assembly of claim 1, wherein the retainer includes a bolt defining a head portion and a shank portion integrally extending from the head portion, the at least one end portion being defined by the head portion, wherein the head portion defines a larger cross-sectional area than a cross-sectional area of the shank portion and is adapted to be seated on the step.

4. The coupler assembly of claim 1, wherein the at least one slot of the apparatus includes a first slot and a second slot, and the at least one end portion of the retainer includes a first end portion and a second end portion, wherein the first slot is adapted to receive and facilitate shielding of the first end portion, and the second slot is adapted to receive and facilitate shielding of the second end portion.

5. The coupler assembly of claim 4, wherein the first slot and the second slot are defined diametrically oppositely to each other across the annular body around a common axis.

6. The coupler assembly of claim 4, wherein the retainer includes a bolt defining a head portion and a shank portion integrally extending from the head portion, the shank portion adapted to pass through the end of the pin to reveal an end of the shank portion outwardly of the pin, the coupler assembly further including a nut adapted to be coupled to the end of the shank portion to secure the retainer with the pin, wherein the first end portion of the retainer is defined by the head portion, the second end portion of the retainer is defined by the end of the shank portion, and the second slot is adapted to receive and facilitate shielding of the nut along with receiving and facilitating shielding of the second end portion.

7. The coupler assembly of claim 1, wherein the apparatus includes a layer of an anti-seizure coating.

8. The coupler assembly of claim 7, wherein the anti-seizure coating includes nickel.

9. The coupler assembly of claim 1, wherein the step is disposed radially between the at least one end portion of the retainer and the pin.

10. The coupler assembly of claim 3, wherein the step is disposed radially between the head portion of the bolt and the pin.

11. A grader machine, comprising:

a main frame portion and a sub-frame portion movable relative to the main frame portion;

a drawbar pivotally coupled to the sub-frame portion and adapted to be raised and lowered relative to the sub-frame portion;

a circle member rotatably coupled relative to the drawbar;

a beam extending from the circle member;

a moldboard for engaging a work surface underlying the grader machine;

a bracket supporting the moldboard;

a pin passed through and rotatably coupling the bracket and the beam to each other about the pin, the pin defining an end extending outwardly from an assembly of the bracket and the beam;

a retainer engaged with the end to retain the pin with the bracket and the beam, the retainer defining at least one end portion extending outwardly from the end; and an apparatus mounted around the pin at the end to shield the at least one end portion of the retainer extending outwardly from the end, wherein the apparatus includes an annular body defining an outer peripheral surface, an inner peripheral surface, and at least one slot extending from the outer peripheral surface to the inner peripheral surface, the retainer passes through the end and the at least one slot, and the at least one slot receives and facilitates shielding of the at least one end portion of the retainer, the at least one slot includes a first slot portion extending from the outer peripheral surface towards the inner peripheral surface, and a second slot portion extending from the first slot portion to the inner peripheral surface, and a cross-sectional area of the first slot portion is larger than a cross-sectional area of the second slot portion defining a step between the first slot portion and the second slot portion.

12. The grader machine of claim 11, wherein the pin defines a longitudinal axis and the annular body of the apparatus defines an apparatus axis, the apparatus being co-axially mounted around the pin at the end such that the apparatus axis aligns with the longitudinal axis.

13. The grader machine of claim 11, wherein the retainer includes a bolt defining a head portion and a shank portion integrally extending from the head portion, the at least one end portion being defined by the head portion, wherein the head portion defines a larger cross-sectional area than a cross-sectional area of the shank portion, the head portion being seated on the step.

14. The grader machine of claim 11, wherein the at least one slot of the apparatus includes a first slot and a second slot, and the at least one end portion of the retainer includes a first end portion and a second end portion, wherein the first slot receives and facilitates shielding of the first end portion, and the second slot receives and facilitates shielding of the second end portion.

15. The grader machine of claim 14, wherein the first slot and the second slot are defined diametrically oppositely to each other across the annular body around a common axis.

16. The grader machine of claim 14, wherein the retainer includes a bolt defining a head portion and a shank portion integrally extending from the head portion, the shank portion passing through the end of the pin to reveal an end of the shank portion outwardly of the pin, the grader machine further including a nut coupled to the end of the shank portion to secure the retainer with the pin, wherein the first end portion of the retainer is defined by the head portion, the second end portion of the retainer is defined by the end of the shank portion, and the second slot receives and facilitates shielding of the nut along with receiving and facilitating shielding of the second end portion.

17. The grader machine of claim 11, wherein the apparatus includes a layer of an anti-seizure coating.

18. The grader machine of claim 17, wherein the anti-seizure coating includes nickel.

19. The grader machine of claim 11, wherein the step is disposed radially between the at least one end portion of the retainer and the pin.

20. The coupler assembly of claim 13, wherein the step is disposed radially between the head portion of the bolt and the pin.

* * * * *